United States Patent [19]

Ashby

[11] Patent Number: 4,969,594

[45] Date of Patent: Nov. 13, 1990

[54] BUSINESS FORMS MAILER AND RELATED MANUFACTURING PROCESS

[75] Inventor: Robert E. Ashby, Quakertown, Pa.

[73] Assignee: Moore Business Forms, Inc., Grand Island, N.Y.

[21] Appl. No.: 367,038

[22] Filed: Jun. 16, 1989

[51] Int. Cl.[5] ..... B65D 27/10

[52] U.S. Cl. ..... 229/69; 53/460; 53/468; 493/213

[58] Field of Search ..... 53/460, 468; 493/213; 229/69

[56] References Cited

U.S. PATENT DOCUMENTS

| | | | |
|---|---|---|---|
| 211,725 | 1/1879 | Foster . | |
| 2,148,886 | 2/1939 | Wanser . | |
| 2,722,369 | 11/1955 | Reuter . | |
| 3,026,018 | 3/1962 | Stratton et al. . | |
| 3,151,803 | 10/1964 | Kaminski . | |
| 3,254,828 | 6/1966 | Lerner . | |
| 3,265,289 | 8/1966 | Hiersteiner . | |
| 3,310,225 | 3/1967 | Hoblit . | |
| 3,325,188 | 6/1967 | Hiersteiner | 229/69 |
| 3,339,827 | 9/1967 | Steidinger | 229/69 |
| 3,437,259 | 8/1969 | Steidinger . | |
| 3,507,444 | 4/1970 | Werby . | |
| 3,523,638 | 8/1970 | Moonan . | |
| 3,557,519 | 1/1971 | Lyon, Jr. | 53/460 |
| 3,633,816 | 1/1972 | Alton | 229/69 |
| 3,702,171 | 11/1972 | Levine . | |
| 3,837,565 | 9/1974 | Johnsen . | |
| 4,277,016 | 7/1981 | Wakeman et al. . | |
| 4,531,993 | 7/1985 | Bradley | 53/460 |
| 4,709,399 | 11/1987 | Sanders . | |
| 4,709,850 | 12/1987 | Wagner . | |
| 4,776,510 | 10/1988 | Jenkins . | |
| 4,779,792 | 10/1988 | Lombardo | 229/69 |
| 4,809,906 | 3/1989 | Lombardo | 229/69 |

FOREIGN PATENT DOCUMENTS

2900226C2 12/1983 Fed. Rep. of Germany .

*Primary Examiner*—Stephen P. Garbe

*Attorney, Agent, or Firm*—Nixon & Vanderhye

[57] ABSTRACT

A business forms mailer construction comprising an upper panel, at least one intermediate panel, and a lower panel; the upper panel is adhesively secured to the at least one intermediate panel, and the at least one intermediate panel is adhesively secured to the lower panel by glue lines, one of which extends along one side of the intermediate and lower panels. Also provided are a pair of slitter guide marks applied to one of the upper and lower panels, on either side of the glue line, so that by alignment of a slitting mechanism with the inner of the pair of guide marks, the mailer may be opened along one side for the insertion of one or more additional sheets. Alignment with the outer of the guide marks results in removal of a marginal portion of the mailer, but with the latter remaining sealed.

21 Claims, 2 Drawing Sheets

BUSINESS FORMS MAILER AND RELATED MANUFACTURING PROCESS

BACKGROUND AND SUMMARY OF THE INVENTION

This invention relates to the production of multi-part mailers. Specifically, the invention relates to mailer blank constructions, and a related process which facilitates the manufacture of mailers which may or may not require insertion of additional documents after printing but prior to mailing.

Generally, it is known in the art to provide mailers which include document inserts, such as return envelopes, billing statements and the like. For example, U.S. Pat. No. 3,437,259 discloses a continuous envelope assembly which includes a side edge flap on the envelope front panel which, after insertion of a document through the open side, may be folded over and secured to the envelope back panel.

U.S. Pat. No. 4,277,016 discloses a typical, multi-ply continuous web assembly wherein the envelope panels and inserts are formed substantially simultaneously. However, this type of construction is not suitable for applications where the interior surface of the envelope panels are to be printed with information by, for example, a continuously fed laser printer.

U.S. Pat. No. 4,776,510, owned by the assignee of the present invention, discloses an envelope construction which is designed specifically for printing in a continuously fed laser printer and which, prior to sealing, has a return envelope affixed to an interior surface thereof.

The present invention provides an improved mailer construction which facilitates the opening of a sealed multi-part envelope, as necessary, for the insertion of one or more additional sheets. The invention also provides a means for quickly resealing the opened envelope.

In one exemplary embodiment of the invention, a three-ply continuous web is divided by transverse lines of perforations into individual mailer form sets, each comprising a front panel, at least one intermediate panel and a lower panel.

The front panel, defined by upper, lower and side edges has marginal portions which have formed therein longitudinally extending lines of feed holes for engagement with conventional tractor drive mechanisms. The back side of the front panel has lines of heat sealable adhesive extending about its periphery, i.e. along the top, bottom and side edges, for securing the front panel to the one (or uppermost if more than one) intermediate panel. In addition, the front panel is provided with lines of perforation which extend about the periphery of the panel but inside the peripheral lines of heat sealable adhesive. For some exemplary constructions, the front panel is also provided with a die-cut window area which may or may not have a clear thin film plastic sheet applied thereto.

The intermediate and lower panels together comprise a lower form portion in that these two panels are secured together by horizontal and vertical glue lines of the hot melt or cold adhesive type. Each of the intermediate and lower panels also are provided with horizontal and vertical lines of perforation which, when the upper panel and the intermediate and lower panels are superposed, are vertically aligned with the peripheral lines of perforation of the upper panel.

Of significance to the present invention is the fact that the marginal portion on one side of the form is wider than the marginal portion on the other side of the form, principally to accommodate a pair of slitter guide marks on one side of the form (the right side as viewed in FIGS. 1 and 2). The slitter guide marks are provided on the upper panel, and are arranged to straddle the vertical glue line which secures the underside of the intermediate form (or the underside of the lowermost intermediate form if more than one) to the lower panel. In this way, when a sealed form construction is otherwise substantially ready for mailing, a slitter mechanism is aligned with one or the other of the slitter guide marks, depending on whether or not an additional sheet must be inserted between the intermediate and lower panels prior to mailing. In the event no further document is to be added, the slitter mechanism is aligned with the outermost guide mark so that the slitter mechanism removes only the excess marginal portion of the form containing the feed holes, but leaves the vertical glue line between the intermediate and lower panels intact.

However, in the event an additional sheet or sheets must be inserted prior to mailing, the slitter mechanism is aligned with the innermost of the slitter guide marks so that a larger marginal area is removed, i.e. to the inside of the vertical glue line thereby opening the side edge between the intermediate and lower panels.

It will be understood that the inside slitter guide mark nevertheless remains outside the line of heat seal adhesive which secures the upper panel to the intermediate panel, so that the choice of slitter guide marks has no bearing on the securement of the upper form panel to the lower form portion comprising the intermediate and lower panels.

After the additional sheet (or sheets) has been inserted, a release liner may be pulled off the upper face of an adjacent transfer tape strip (double sided adhesive tape) which is fastened to the front face of the lower panel, just inside the newly slit edge and the intermediate and lower panels are then adhesively secured merely by manually applying pressure along the side edge.

It will therefore be appreciated that the present invention, in its broader aspects, comprises a first panel defined by a top edge, bottom edge, and two side edges; a second panel defined by a top edge, bottom edge and two side edges in alignment with the first panel; the first and second panels secured by glue lines extending generally along the top, bottom and side edges; and a pair of slitter guide marks disposed on one of the panels on either side of one of the glue lines extending generally along one of the side edges.

It will further be appreciated from the above, that the present invention also relates to a process for manufacturing a mailer which, in its broader aspects, includes the following steps:

(a) providing an envelope blank comprising an upper panel, at least one intermediate panel, and a lower panel; the upper panel being secured to the at least one intermediate panel by first adhesive means, and the at least one intermediate panel being secured to the lower panel by second adhesive means, the second adhesive means including a glue line extending along one side of the at least one intermediate and lower panels; and a pair of slitter guide marks applied to one of the upper and lower panels, on either side of said glue line; and (b) aligning a slitter device with the first or second slitter guide marks, depending on whether or not one or more sheets are to be inserted into the envelope.

From the above, it will be appreciated that the present invention provides a relatively simple form construction and related process which facilitates opening and resealing of a mailer where necessary for the purpose of inserting one or more additional sheets into the mailer.

Other objects and advantages of the subject invention will become apparent from the detailed description which follows.

DETAILED DESCRIPTION OF THE DRAWINGS

Figure 1:
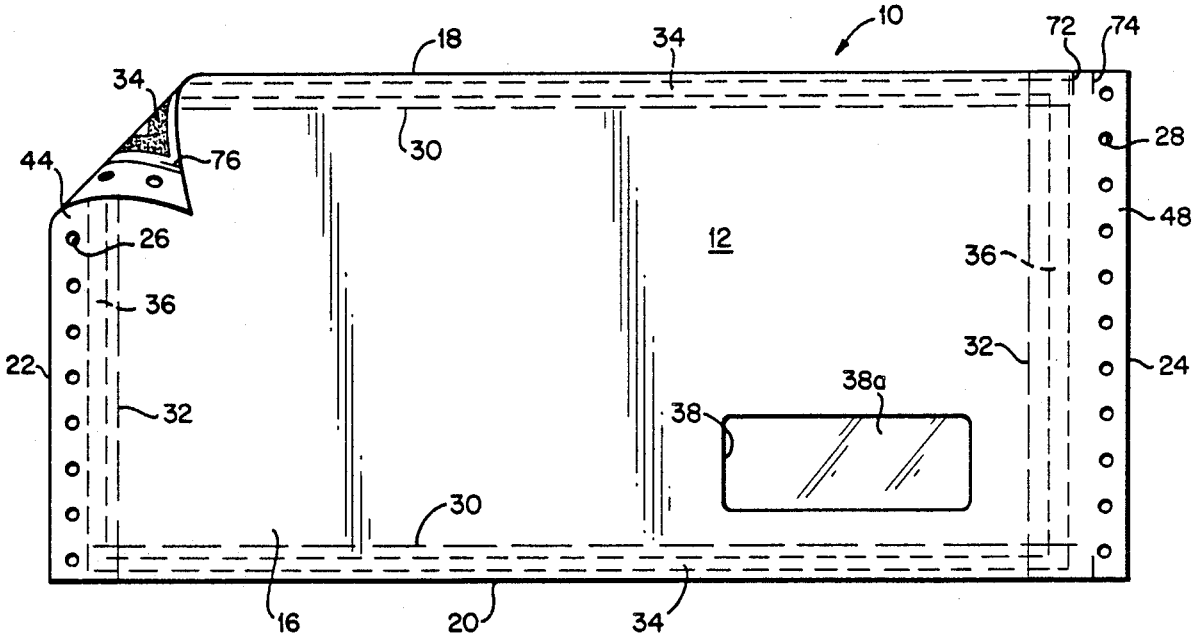
FIG. 1 is a top view of a front panel of a mailer in accordance with an exemplary embodiment of the invention; and, FIG. 2 is a plan view of an intermediate and lower panel of a mailer in accordance with the subject invention, with the intermediate panel partially folded to show the details of the lower panel.
Figure 2:
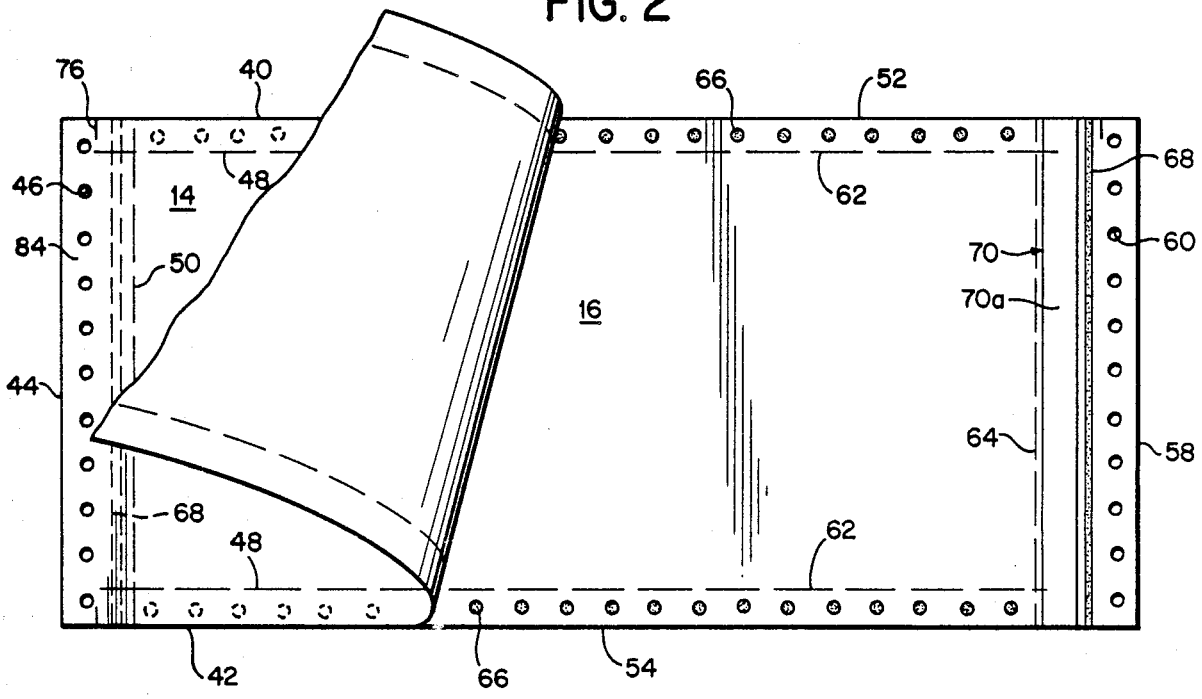

With reference to FIGS. 1 and 2, the envelope blank construction in accordance with this invention includes an upper panel 12, an intermediate panel 14 and a lower panel 16. While only one intermediate panel 14 is shown, it will be understood that additional intermediate panels or sheets may be included within the blank construction.

The upper panel 12 is defined by an upper edge 18, a lower edge 20, and a pair of side edges 22, 24. A line of feed holes 26 extends along the marginal portion of the panel, adjacent edge 22, and a similar line of feed holes 28 extends along the marginal area adjacent edge 24 to provide means by which the envelope of blank construction, in continuous web form, may be driven via engagement with a conventional tractor drive mechanism or the like.

The upper panel is also formed with a pair of perforation lines 30 extending transversely of the panel generally adjacent the upper edge 18 and lower edge 20. Similarly, longitudinal perforation lines 32 extend generally adjacent and parallel to the lines of feed holes 26, 28.

The back side of the upper panel 12 is provided with transverse lines of heat seal type adhesive 34 which extend parallel to edges 18, 20, respectively, but outside the perforation lines 30, 32. Similarly, longitudinally extending heat sealable adhesive lines 36 are provided adjacent and inside the perforation lines 32.

The upper envelope panel 12 may also be provided with a die-cut window 38 which, if desired, may be covered by a clear plastic film 38*a*.

The intermediate panel 14 is substantially similar to the upper sheet 12 with the exception that the intermediate sheet does not include a die-cut window nor does the intermediate sheet include peripheral lines of heat seal type adhesive on its back side. Thus, and with specific reference to FIG. 2, the intermediate sheet 14 is provided with an upper edge 40, a lower edge 42, and a pair of side edges 44 (only one of which is shown). Sheet 14 is also provided with a longitudinally extending line of feed holes 46 which, when the panels 12 and 14 are placed in vertical alignment, are aligned with the line of feed holes 26. It will be understood that the opposite side of the intermediate sheet 14 is also formed with a longitudinally extending line of feed holes (not shown).

Similar to the construction of the upper sheet 12, the intermediate sheet 14 is provided with transverse lines of perforation 48 and longitudinally extending lines of perforation 50 (only one of which is shown), which vertically align with similar lines of perforation 30, 32 of the upper sheet 12.

The lower sheet 16 is defined by an upper edge 52, a lower edge 54, and a pair of side edges 58 (only one of which is shown). Sheet 16 is also formed with marginal lines of longitudinally extending feed holes 60 (only one line of which is illustrated in FIG. 2). As described above, these longitudinally extending lines of feed holes vertically align with the feed holes of panels 12 and 14 when the panels are superposed one over the other.

The sheet 16 is also formed with transverse lines of perforations 62 extending parallel to the upper and lower edges 52, 54, as well as a pair of longitudinally extending lines of perforations 64 (only one of which is shown) which extend parallel to the longitudinally extending lines of feed holes.

Extending between the upper edge 52 and the transverse line of perforations 62 is a line of hot melt or cold type glue spots 66 which may comprise any suitable type of hot melt or cold adhesive. A similar line of glue spots 66 is provided between the lower edge 54 and the adjacent line of perforations 62. At the same time, longitudinally extending solid glue lines 68 are provided adjacent the longitudinally extending lines of feed holes 60, but which lie outside the longitudinally extending lines of perforation 64.

On one side of the panel 16, additional space is provided within the marginal area (defined by the longitudinally extending line of perforation 64 and side edge 58) for the application of a longitudinally extending line of transfer tape 70, and for the utilization of selectable slitter guide marks as explained in greater detail below. Tape 70 may be any conventional double sided adhesive tape, the top face of which is covered with a release liner 70*a*.

With reference now to FIG. 1, a pair of slitter guide marks 72, 74 are provided on the upper sheet 12 between the line of heat seal adhesive 36 and the line of marginal feed holes 28. At the other side of the panel, a single slitter guide mark 76 is provided. When the upper panel 12, is superposed over the second and third panels 14, 16, the slitter guide marks 72, 74 straddle or lie to either side of the longitudinally extending glue lines 68. Of course, depending on the feed orientation of the mailer vis-a-vis the slitter, the guide marks could be provided on the lower sheet or panel.

Figure 3:
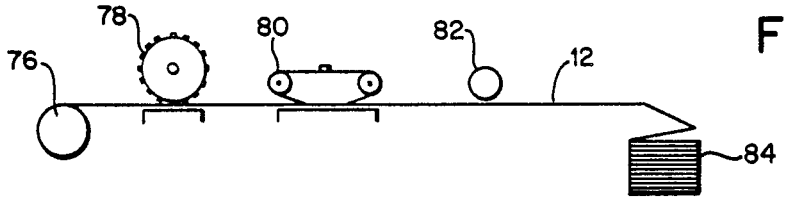
FIG. 3 is a schematic diagram showing production of stock for the upper panel of the form in accordance with this invention.

During manufacture of the form, in accordance with one exemplary embodiment of the invention, three rolls 76, 86 and 90 of paper are provided. With reference to FIG. 3, the continuous stock which will form a plurality of upper panels 12 is drawn from the roll 76, and each panel portion is perforated at 78 and provided with a die-cut window at 80. Thereafter, the heat seal adhesive patterns 34, 36 are applied at 82 and the continuous stock may then be accordion-folded in a box 84.

Figure 4:
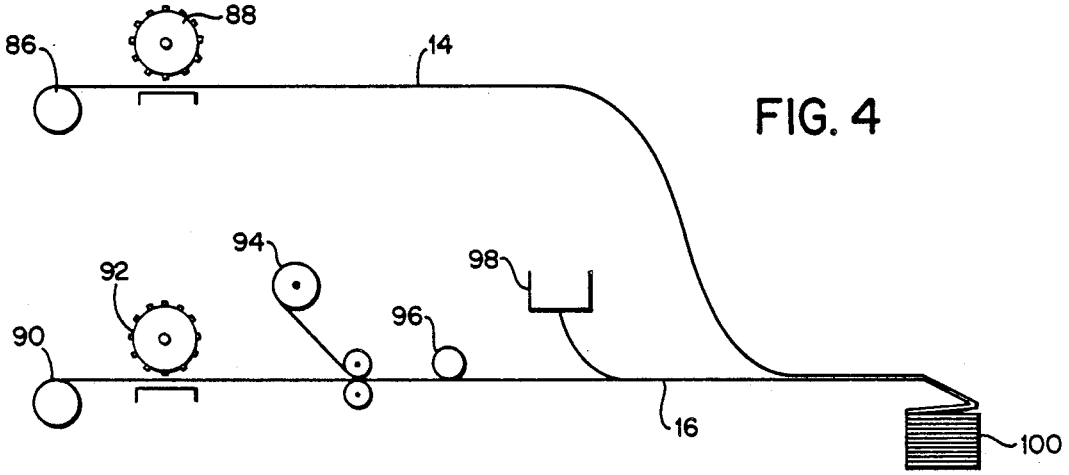
FIG. 4 is a schematic diagram showing production and collation of the intermediate and lower panels for the form in accordance with this invention.

With reference now to FIG. 4, the continuous stock which is to form a plurality of intermediate panels 14 is drawn from roll 86, and each panel is perforated at 88. At the same time, the continuous stock which is to form a plurality of lower panels 16 is drawn from roll 90, and each panel is perforated at 92, and provided with transfer tape 70 at 94. Glue spots 66 are applied at 96 while the longitudinal streams of glue 68 are applied at 98. These continuous webs are superposed and also accordion-folded in a box 100.

Figure 5:
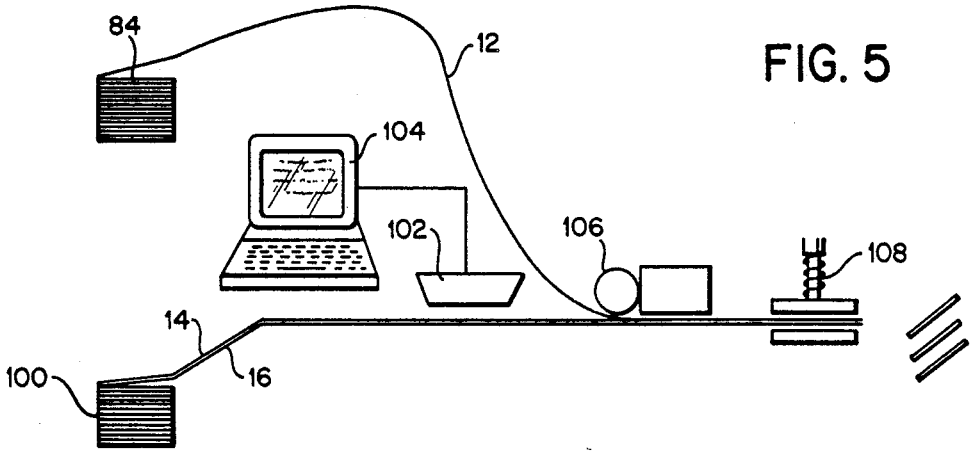
FIG. 5 is a schematic diagram illustrating the printing of the intermediate panel and the collation with the upper panel by the business customer.

Typically, the continuous stock forming upper panels 12 and the continuous stock forming the intermediate and lower panels 14, 16 are shipped to the customer separately, and, in FIG. 5, there is illustrated a typical manner in which the forms are printed and assembled by the business customer. Specifically, the stock forming the upper panels 12 is withdrawn from box 84 and is superposed over the stock forming the intermediate and lower panels 14, 16. However, prior to the superposition of these webs, the stock forming the intermediate panels 14 may be printed at a printing station 102 which applies variable information via computer 104. After the upper, lower and intermediate panels are superposed, the continuous form is fed through a slitter/slash burster machine 106 and heat sealer 108.

If one or more additional sheets are to be inserted between the intermediate panel 14 and lower panel 16 prior to mailing, a slitter mechanism will be positioned on the guide mark 72, i.e. inside the vertically extending glue line 68. On the other hand, if no additional sheets are to be inserted, the slitter mechanism will be positioned on the guide mark 74, i.e. outside the vertically extending glue line 68.

In the event additional documents are to be provided, it will be appreciated that the envelope blank construction will be slit along a line corresponding to slitter guide mark 72 thereby enabling the pocket between panels 14 and 16 to be opened from the side along the slit edge, while upper panel 12 remains sealed to the intermediate panel 14 via heat seal adhesive 34 and 36. After one or more additional documents have been manually inserted, the liner **70*a* is peeled away from the transfer tape 70 and sheet 14 is pressed against the now exposed adhesive surface of the transfer tape to re-close the pocket between sheets 14 and 16**, so that the envelope is now ready for mailing.

In the event no sheets or inserts are to be added, the marginal area of the superposed sheets 12, 14 and 16 may be removed along a line corresponding to the slitter guide mark 74 so that the envelope assembly remains sealed along glue line 68. A similar trimming step occurs on the opposite side of the form just inside the line of marginal feed holes 26.

Upon receipt of the mailer construction by a user, the envelope may be opened by tearing along one or more of the lines of perforations 30, 32, 48, 50 and 62, 64 which extend about the periphery of the envelope in a well known manner.

It will be appreciated that the advantages of the above construction are equally applicable to form constructions which, initially, include only upper and lower panels, such as a simple envelope construction, which might later be associated with an outer mailing envelope.

In accordance with the production sequence described above, and for one exemplary embodiment, the present invention also relates to a method of manufacturing a two-way mailer comprising in its broader aspects the steps of:

(a) providing an envelope blank comprising an upper panel 12, at least one intermediate panel 14, and a lower panel 16; the upper panel 12 being secured to the at least one intermediate panel 14 by first adhesive means 34, 36, and the at least one intermediate panel 14 being secured to said lower panel 16 by second adhesive means 66, 68, the second adhesive means including a glue line extending along one side of said intermediate and lower panels; and a pair of slitter guide marks 72, 74 applied to one of the upper and lower panels, on either side of the glue line; and (b) aligning a slitter device with the first or second slitter guide marks 72, 74, depending on whether or not one or more sheets are to be inserted into the mailer.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A mailer construction comprising a first panel defined by a top edge, bottom edge, and two side edges;

a second panel defined by a top edge, bottom edge and two side edges in alignment with said first panel;

said first and second panels secured by glue lines extending generally along said top, bottom and side edges; and a pair of slitter guide marks disposed on one of said panels on either side of one of said glue lines extending generally along one of said side edges.

2. A mailer construction as defined in claim 1 and wherein additional and selectively useable adhesive is provided on one or the other of said first and second panels along said one edge, laterally inward of said pair of slitter guide marks.

3. A mailer construction as defined in claim 2 wherein said first panel comprises an intermediate panel and wherein a third panel is provided which is superposed over said first panel and secured thereto by adhesive including a line of adhesive located laterally inwardly of said pair of slitter guide marks.

4. A mailer construction as defined in claim 3 wherein said glue lines comprise hot melt type glue; said adhesive comprises heat seal adhesive; and said selectively useable adhesive comprises double sided adhesive tape, one side of which is covered by a release liner.

5. A mailer construction according to claim 1 wherein said first and second panels include marginal areas on either side thereof, defined by longitudinally extending lines of perforations, and wherein said glue lines extending along said side edges and said slitter guide marks are located in one of said marginal areas.

6. A mailer construction according to claim 5 wherein marginal lines of feed holes are provided in each marginal area.

7. A mailer construction according to claim 5 wherein said selectively useable adhesive is located in said one of said marginal areas.

8. A business forms mailer construction comprising:

an upper panel, at least one intermediate panel, and a lower panel; said upper panel being secured to said at least one intermediate panel by first adhesive means, and said at least one intermediate panel being secured to said lower panel by second adhesive means, said second adhesive means including a glue line extending along one side of said intermediate and lower panels; and a pair of slitter guide marks applied to one of said upper and lower panels, on either side of said glue line.

9. A business forms mailer construction as defined in claim 8 wherein a third adhesive means is provided between said intermediate and lower panels laterally inwardly of said pair of slitter guide marks, and extending substantially parallel to said glue line.

10. A business forms mailer construction as defined in claim 9 wherein said third adhesive comprises a double sided adhesive tape secured to said lower panel, an upper face of said transfer tape being covered by a release liner.

11. A business forms mailer construction as defined in claim 8 wherein said upper, intermediate and lower panels have vertically aligned marginal areas extending along side edges thereof, said glue line and said pair of slitter guide marks lying within one of said marginal areas.

12. A business forms mailer construction as defined in claim 9 wherein said upper, intermediate and lower panels have vertically aligned marginal areas extending along side edges thereof, said glue line and said pair of slitter guide marks lying within one of said marginal areas, and wherein said third adhesive means also lies within said one of said marginal areas.

13. A business forms mailer construction as defined in claim 12 wherein said one of said marginal areas has a greater width than the other of said marginal areas.

14. A business forms mailer construction as defined in claim 11 wherein said marginal areas are defined by lines of perforations extending substantially parallel to said edges.

15. A business forms mailer construction as defined in claim 8 wherein each of said panels includes lines of perforations extending about top, bottom and side edges thereof, and wherein said first and second adhesive means extend along said top, bottom and side edges, between said lines of perforations and said edges.

16. A business forms mailer construction as defined in claim 15 wherein said third adhesive means extends along said glue lines laterally outwardly of one of the lines of perforations extending along one of said side edges.

17. In a method of manufacturing a business form envelope, the process comprising the steps of:

(a) providing an envelope blank comprising an upper panel, at least one intermediate panel, and a lower panel; said upper panel being secured to said at least one intermediate panel by first adhesive means, and said at least one intermediate panel being secured to said lower panel by second adhesive means, said second adhesive means including a glue line extending along one side of said intermediate and lower panels; and a pair of slitter guide marks applied to one of said upper and lower panels, on either side of said glue line; and (b) aligning a slitter device with one of said first or second slitter guide marks.

18. The method of claim 17 wherein step (b) is carried out by aligning the slitter device with the first slitter guide mark when no sheet is to be inserted into the envelope.

19. The method of claim 18 and including the further steps of:

(c) slitting the envelope blank to open said blank from said one side;

(d) inserting said one or more sheets; and (e) activating a third, selectively useable adhesive between said intermediate and third panels to reseal said blank.

20. The method of claim 19 wherein step (e) is carried out by peeling a release liner from a strip of double sided adhesive tape.

21. The method of claim 17, wherein step (b) is carried out by aligning the slitter device with the second slitter guide mark when one or more sheets are to be inserted into the envelope.

* * * * *